US010451271B2

(12) United States Patent
Taylor et al.

(10) Patent No.: US 10,451,271 B2
(45) Date of Patent: Oct. 22, 2019

(54) STAGED FUEL BURNER WITH JET INDUCED EXHAUST GAS RECYCLE

(71) Applicant: Honeywell Interntional Inc., Morristown, NJ (US)

(72) Inventors: Curtis L. Taylor, Fishers, IN (US); Bradley D. Patterson, Dunkirk, IN (US); Marek Scholler, Olomoucky kraj (CZ); Jayson Perdue, New Castle, IN (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 133 days.

(21) Appl. No.: 15/849,354

(22) Filed: Dec. 20, 2017

(65) Prior Publication Data

US 2019/0186731 A1 Jun. 20, 2019

(51) Int. Cl.

| | |
|---|---|
| ***F23B 30/00*** | (2006.01) |
| ***F23C 9/08*** | (2006.01) |
| ***F23C 9/06*** | (2006.01) |

(52) U.S. Cl.

CPC ..... *F23B 7/007* (2013.01); *F23C 9/06* (2013.01); *F23C 9/08* (2013.01)

(58) Field of Classification Search

CPC ..... F23C 9/06; F23C 9/08; F23J 15/00

USPC ..... 431/8, 278

See application file for complete search history.

(56) References Cited

U.S. PATENT DOCUMENTS

| | | | | | |
|---|---|---|---|---|---|
| 3,927,958 | A | * | 12/1975 | Quinn | F02C 3/34 431/116 |
| 4,130,388 | A | * | 12/1978 | Flanagan | F23C 7/02 431/10 |
| 4,629,413 | A | | 12/1986 | Michelson et al. | |
| 4,800,866 | A | | 1/1989 | Finke | |
| 5,195,884 | A | * | 3/1993 | Schwartz | F23C 6/047 431/116 |
| 5,269,679 | A | * | 12/1993 | Syska | F23C 6/045 431/115 |
| 5,292,244 | A | * | 3/1994 | Xiong | B01F 5/0451 239/414 |
| 5,413,477 | A | | 5/1995 | Moreland | |
| 5,473,881 | A | * | 12/1995 | Kramnik | F23R 3/28 60/737 |
| 6,190,159 | B1 | | 2/2001 | Moore et al. | |

(Continued)

FOREIGN PATENT DOCUMENTS

EP 2500645 A1 9/2012

*Primary Examiner* — Gregory L Huson
*Assistant Examiner* — Nikhil P Mashruwala

(57) ABSTRACT

The pre-mix burner assembly includes a jet pump comprising a combustion air tube, a flue gas inlet, and a suction chamber. The combustion air tube has an inlet and a tapered nozzle, and it is connected to a combustion gas fan. The flue gas inlet is connected to the suction chamber and the furnace chamber or other flue gas source. The suction chamber surrounds the combustion air tube, and it has a jet pump nozzle with a discharge. The combustion air exiting the combustion air nozzle creates a negative pressure in the suction chamber and draws flue gas into the suction chamber. There is a burner housing positioned downstream of the jet pump discharge. There is a fuel gas inlet connected to a mixing tube in the burner housing, and a burner block connected to the outlet of the burner housing.

20 Claims, 2 Drawing Sheets

(56) References Cited

U.S. PATENT DOCUMENTS

| | | | | |
|---|---|---|---|---|
| 7,322,818 | B2 * | 1/2008 | Stephens | F23C 9/00 126/91 A |
| 8,075,305 | B2 * | 12/2011 | Stephens | F23C 6/047 431/162 |
| 9,739,481 | B2 * | 8/2017 | Lang | F23C 9/00 |
| 9,739,483 | B2 * | 8/2017 | Akbarimonfared | F23D 14/08 |
| 9,982,885 | B2 * | 5/2018 | Taylor | F23C 9/06 |
| 2016/0370002 | A1 | 12/2016 | Taylor et al. | |
| 2019/0093604 | A1 * | 3/2019 | Hampson | F02M 26/19 |

* cited by examiner

STAGED FUEL BURNER WITH JET INDUCED EXHAUST GAS RECYCLE

The present disclosure relates to devices, methods, and systems utilizing a pre-mix burner with a combustion air driven jet pump.

BACKGROUND

Oxides of nitrogen in the form of Nitrogen Oxide (i.e., NO) and Nitrogen Dioxide ($NO_2$) (oxides of nitrogen can generally be referred to as: NOx) are generated by the burning of fossil fuels. Along with NOx from vehicles, NOx from fossil fuel fired industrial and commercial heating equipment (e.g., furnaces, ovens, etc.) is a major contributor to poor air quality and smog.

Flue gas recycling is an industry accepted way to achieve low NOx emissions in fossil fuel fired combustion applications. Numerous field and laboratory studies have proven the beneficial effect of recycling flue gas using a variety of fossil fuel burner-sealed fired chamber test arrangements. However, the addition of flue gas recycling to any fired application requires increased equipment complexity, capital, and/or operational expense.

One method to achieve flue gas recycling using premixed burners (using a combustion air and fuel gas mixture), is to have the flue gas ducted back to a point near the combustion air intake where it can enter the combustion air fan to be mixed with the combustion air and fuel gas. This method requires additional piping and assembly around the burner and boiler (or other sealed fired chamber).

It also requires an enlargement or upsizing of the combustion air fan to handle the increased volume of the added flue gas. Larger fans have increased cost and use more electricity per unit of heat produced. Further, these fans can become fouled due to the hot, corrosive flue gas and require the use of higher cost alloy materials, and/or additional cleaning and maintenance to keep the fan operational.

Another method, applicable to non-premixed burners, is to use an auxiliary fan to suction flue gas from the exhaust stack or fired chamber, and discharge that flue gas into the burner housing where it mixes with the incoming combustion air provided by the combustion air fan. This method requires additional flue gas piping and an additional corrosion resistant, high temperature rated fan to transport the hot flue gas.

Therefore, there is a need for a method of exhaust gas recycle in fuel fired equipment that reduces the complexity of the system. It would be desirable if the method also lowered the capital and operating costs, providing an economical process.

DETAILED DESCRIPTION

Figure 1:
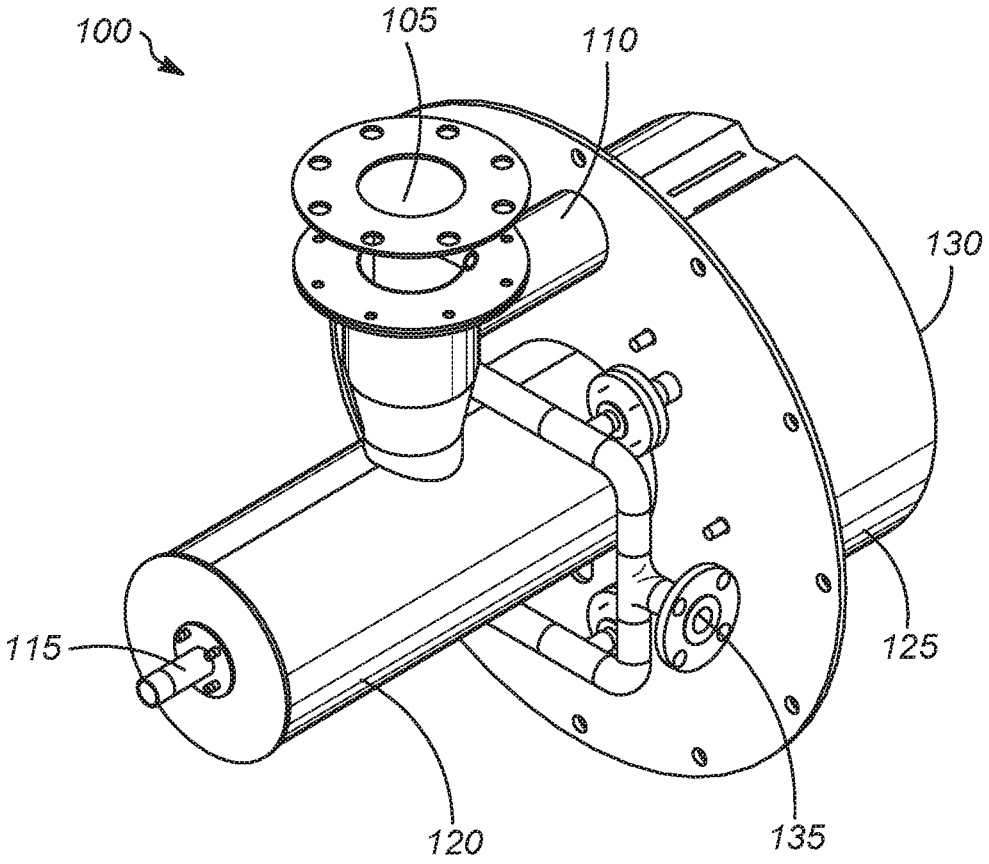
FIG. 1 is an angled overhead view of a burner with a combustion air driven jet pump according to one or more embodiments of the present disclosure.

Apparatuses, methods, and systems for utilizing a pre-mix burner with a combustion air driven jet pump are described herein. One pre-mix burner assembly includes a jet pump which includes a combustion air tube with a combustion air nozzle, a flue gas inlet, and a suction chamber. The combustion air nozzle outlet has a smaller diameter than the combustion air tube. In this manner, combustion air is moved from a larger volume area into a smaller volume area, thereby speeding the flow of the air toward the outlet of the jet pump.

The combustion air inlet is connected to a combustion air fan. The combustion air fan provides a volume of combustion air and combustion air pressure sufficient to drive the jet pump. This arrangement provides a negative pressure to pull flue gas from the flue gas inlet to be mixed with a combustion air. It allows introduction of flue gas without having to increase piping or provide additional or upgrade fan components to either the flue gas path or the combustion air path as will be discussed in more detail below.

In some embodiments, the jet pump nozzle is also tapered so that the jet pump discharge has a smaller diameter than the diameter of the suction chamber. This structure can also aid in creating negative pressure.

In one aspect, the invention relates to a pre-mix burner assembly. In one embodiment, the pre-mix burner assembly includes a jet pump comprising a combustion air tube, a flue gas inlet, and a suction chamber. The combustion air tube receives combustion air, and it has an inlet at one end and a combustion air nozzle at the opposite end. The combustion air nozzle tapers to an outlet having a smaller diameter than the diameter of the combustion air tube. The combustion air tube is connected to a combustion air fan. The flue gas inlet is connected to the suction chamber and a source of flue gas, such as a furnace chamber or other flue gas source. The suction chamber surrounds the combustion air tube and the combustion air nozzle, and it has a jet pump nozzle with a jet pump discharge. The combustion air exiting the combustion air nozzle creates a negative pressure in the suction chamber and draws flue gas from the flue gas inlet into the suction chamber. The pre-mix burner assembly includes a burner housing positioned downstream of the jet pump discharge to receive the combustion air and flue gas from the jet pump. There is a mixing tube positioned in the burner housing which extends away from the outlet of the burner housing. The pre-mix burner assembly also includes a fuel gas inlet connected to the burner housing to allow fuel gas to mix with the combustion air and flue gas in the mixing tube to form a mixture of combustion air, flue gas, and fuel gas. The fuel gas inlet extends into the mixing tube. The assembly also includes a burner block connected to the outlet of the mixing tube.

In some embodiments, the combustion air tube and the combustion chamber are arranged at an angle to the burner housing. This arrangement reduces the footprint of the burner assembly, which can be useful in modifying existing burners.

In some embodiments, the jet pump discharge is connected to the burner housing at a position near the middle of the burner housing. The mixing tube extends away from the outlet of the burner housing beyond the position where the jet pump discharge is connected to the burner housing. The mixing tube has an open end opposite the outlet of the burner housing.

In some embodiments, the burner assembly includes a flame stabilizer at the outlet of the mixing tube.

In some embodiments, the burner assembly includes a secondary fuel gas inlet connected to a manifold having at least one riser extending through an opening in the burner block to a secondary fuel gas tip providing fuel gas to a secondary flame zone.

In some embodiments, the combustion air nozzle outlet has a diameter d and the jet pump discharge has a diameter D, and wherein a ratio of the diameter d to the diameter D is between about 0.2 and about 0.9.

In some embodiments, the distance from the combustion air nozzle outlet to the inlet of the burner housing is about 0.8 d to about 2.0 d.

In some embodiments, the jet pump nozzle is tapered, and the jet pump nozzle discharge has a smaller diameter than a diameter of the suction chamber.

Figure 2:
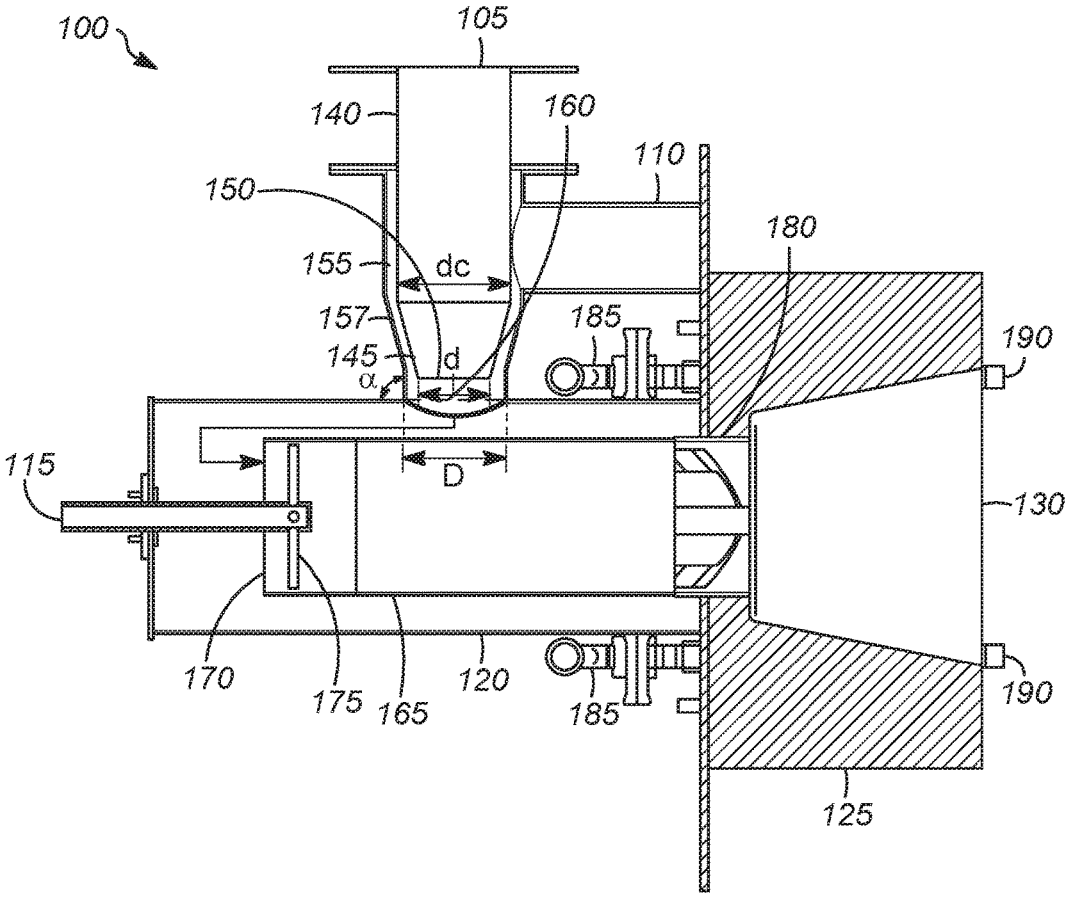
FIG. 2 is a cutaway side view of a burner with a combustion air driven jet pump according to one or more embodiments of the present disclosure.

FIGS. 1 and 2 illustrate one embodiment of a pre-mix burner assembly 100. FIG. 1 is an angled overhead view of a pre-mix burner assembly 100 with a combustion air driven jet pump according to one or more embodiments of the present disclosure. FIG. 2 is a cutaway side view of a pre-mix burner assembly of FIG. 1.

In the embodiment of FIGS. 1 and 2, the pre-mix burner assembly 100 includes a combustion air inlet 105. Combustion air is air received from outside the pre-mix burner assembly 100 into the combustion air inlet 105 for use in the combustion process (e.g., ambient air). Flue gas enters through flue gas inlet 110. Fuel gas is added into the burner housing 120 via fuel gas inlet 115. The combustion air/fuel gas/flue gas mixture is ignited in the burner block 125, and the flame and resultant flue gas exits at burner outlet 130. There can optionally be a secondary fuel gas inlet 135, if desired.

The embodiments of the present disclosure can be constructed from any suitable material. Suitable materials include, but are not limited to, rolled and formed sheet metal, tubing, and/or pipe.

FIG. 2 illustrates the interior of pre-mix burner assembly 100. The pre-mix burner assembly 100 includes jet pump comprising a combustion air tube 140, a flue gas inlet 110, and a suction chamber 155. The combustion air tube 140 has a combustion air inlet 105 on one end and a combustion air nozzle 145 on the opposite end. Combustion air is air received from outside the assembly into the combustion air tube 140 for use in the combustion process (e.g., ambient air). The combustion air inlet 105 is connected to a combustion air fan (not shown) provided upstream of the combustion air inlet 105. The combustion air fan provides a volume of combustion air and combustion air pressure sufficient to drive the jet pump.

The combustion air nozzle 145 tapers to a combustion air nozzle outlet 150, which has a smaller diameter (d) than the diameter (dc) of the combustion air tube 140. As used herein, the term diameter can be a diameter of a fluid path having circular cross section or can be a measurement of a largest width of a fluid path having a non-circular cross section (e.g., oval, rectangular). As illustrated in FIG. 2, the combustion air nozzle 145 is frustoconical.

The combustion air enters the combustion air nozzle 145, accelerates and ejects into the suction chamber 155, creating a negative pressure condition in the suction chamber 155 when the combustion air fan is operating. The suction chamber 155 is connected to the flue gas inlet 110. The flue gas inlet 110 is also connected to a source of flue gas, such as a furnace chamber or other flue gas source. The negative pressure in the suction chamber 155 draws flue gas from the flue gas source through the flue gas inlet 110 into the suction chamber 155.

The suction chamber 155 includes a jet pump nozzle 157 with a jet pump discharge 160. As shown, jet pump nozzle 157 is tapered, and the jet pump discharge 160 has a diameter less than the diameter of the suction chamber 155. Alternatively, the suction chamber 155 and the jet pump nozzle 157 can have a constant diameter. The combustion air and flue gas exit the jet pump nozzle 157 through jet pump discharge 160.

In this embodiment, the combustion air tube 140 and suction chamber 155 form an angle $\alpha$ with the burner housing 120. The angle $\alpha$ typically ranges from about 5° to about 175°, or about 30° to about 150°, or about 60° to about 120°, or about 75° to about 105°.

The jet pump discharge 160 is connected to the inlet of the burner housing 120 at a position near the middle of the burner housing 120, e.g., between about 25 and 75% of the length of the burner housing 120. There is a mixing tube 165 positioned in the burner housing 120. The mixing tube 165 is surrounded by the burner housing 120. The mixing tube 165 extends away from the outlet of the burner housing 120 beyond the position where the jet pump discharge 160 is connected to the burner housing 120. When the combustion air and flue gas enter the burner housing 120, the presence of the mixing tube 165 forces the gases around the end of the mixing tube 165 and into the inlet 170 of the mixing tube 165. The combustion air and flue gas are mixed in the burner housing 120.

Fuel gas is added through fuel gas inlet 115 into the mixing tube 165. In some embodiments, the fuel gas inlet 115 includes a manifold 175 which is positioned inside the mixing tube 165 and which contains one or more fuel inlets (not shown). In this way, the fuel can be dispersed and mixed with the combustion air and flue gas in the mixing tube 165 to form a combustion air/flue gas/fuel gas mixture.

The combustion air/fuel gas/flue gas mixture is carried downstream to the burner block 125, where the mixture is ignited in the burner block 125 by a pilot or other ignition means. The flame and resultant flue gas exit at burner outlet 130.

The flame can be stabilized indefinitely by various flame stabilization methods known to those of skill in the art. In some embodiments, there can be a flame stabilizer 180 at the outlet of the burner housing 120, or the outlet of the mixing tube 165, if present. Suitable flame stabilizers include, but are not limited to, swirlers, bluff bodies, and mixing cones.

In embodiments with a secondary fuel gas inlet 135 (shown in FIG. 1), there can be a manifold 185 with one or more risers that extend through openings in the burner block 125 to secondary fuel gas tips 190 in the burner block 125 to provide fuel gas to the secondary flame zone.

In one example embodiment, the combustion air nozzle outlet 150 with diameter (d) and the jet pump discharge 160 with diameter (D) are sized and located according to the following ratios:

1) Combustion air nozzle diameter to jet pump discharge diameter=$0.2<d/D<0.9$
2) Distance from combustion air nozzle exit to burner housing entrance=0.8 d–2.0 d As used herein, "a" or "a number of" something can refer to one or more such things. For example, "a number of resources" can refer to one or more resources. Additionally, the designator "N", as used herein, particularly with respect to reference numerals in the drawings, indicates that a number of the particular feature so designated can be included with a number of embodiments of the present disclosure.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above elements and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

SPECIFIC EMBODIMENTS

While the following is described in conjunction with specific embodiments, it will be understood that this description is intended to illustrate and not limit the scope of the preceding description and the appended claims.

A first embodiment of the invention is a pre-mix burner assembly comprising a jet pump comprising a combustion air tube, a flue gas inlet, and a suction chamber; the combustion air tube receiving combustion air and having an inlet at one end and a combustion air nozzle at the opposite end, the combustion air nozzle tapering to an outlet having a smaller diameter than a diameter of the combustion air tube, the combustion air tube connected to a combustion air fan; the flue gas inlet connected to the suction chamber and a source of flue gas; the suction chamber surrounding the combustion air tube and the combustion air nozzle, the suction chamber having a jet pump nozzle with a jet pump discharge, wherein the combustion air exiting the combustion air nozzle creates a negative pressure in the suction chamber and draws flue gas from the flue gas inlet into the suction chamber, the suction chamber receiving the flue gas; a burner housing positioned downstream of the jet pump discharge to receive the combustion air and flue gas from the jet pump; a mixing tube positioned in the burner housing and extending away from the outlet of the burner housing; a fuel gas inlet extending into the mixing tube to allow fuel gas to mix with the combustion air and flue gas in the mixing tube to form a mixture of combustion air, flue gas, and fuel gas; and a burner block connected to an outlet of the mixing tube. An embodiment of the invention is one, any or all of prior embodiments in this paragraph up through the first embodiment in this paragraph wherein the combustion air tube and the suction chamber are arranged at an angle to the burner housing. An embodiment of the invention is one, any or all of prior embodiments in this paragraph up through the first embodiment in this paragraph wherein the jet pump discharge is connected to the burner housing at a position near the middle of the burner housing, and the mixing tube extends away from the outlet of the burner housing beyond the position where the jet pump discharge is connected to the burner housing, the mixing tube having an open end opposite the outlet of the burner housing. An embodiment of the invention is one, any or all of prior embodiments in this paragraph up through the first embodiment in this paragraph further comprising a flame stabilizer at the outlet of the mixing tube. An embodiment of the invention is one, any or all of prior embodiments in this paragraph up through the first embodiment in this paragraph further comprising a secondary fuel gas inlet connected to a manifold having at least one riser extending through an opening in the burner block to a secondary fuel gas tip providing fuel gas to a secondary flame zone. An embodiment of the invention is one, any or all of prior embodiments in this paragraph up through the first embodiment in this paragraph wherein the combustion air nozzle outlet has a diameter d and the jet pump discharge has a diameter D, and wherein a ratio of the diameter d to the diameter D is between 0.2 and 0.9. An embodiment of the invention is one, any or all of prior embodiments in this paragraph up through the first embodiment in this paragraph wherein a distance from the combustion air nozzle outlet to an inlet of the burner housing is 0.8 d to 2.0 d. An embodiment of the invention is one, any or all of prior embodiments in this paragraph up through the first embodiment in this paragraph wherein the jet pump nozzle is tapered, and the jet pump nozzle discharge has a smaller diameter than a diameter of the suction chamber.

A second embodiment of the invention is a pre-mix burner assembly comprising a jet pump comprising the combustion air tube, a flue gas inlet, and a suction chamber; the combustion air tube receiving combustion air and having an inlet at one end and a combustion air nozzle at the opposite end, the combustion air nozzle tapering to an outlet having a smaller diameter than a diameter of the combustion air tube, the combustion air tube connected to a combustion air fan; the flue gas inlet connected to the suction chamber and a source of flue gas; the suction chamber surrounding the combustion air tube with the combustion air nozzle, the suction chamber having a jet pump nozzle with a jet pump discharge, wherein the combustion air exiting the combustion air nozzle creates a negative pressure in the suction chamber and draws flue gas from the flue gas inlet into the suction chamber, the suction chamber receiving the flue gas; a burner housing positioned downstream of the jet pump discharge to receive the combustion air and flue gas from the jet pump, wherein the jet pump discharge is connected to the burner housing at a position near the middle of the burner housing; a mixing tube positioned in the burner housing and extending away from an outlet of the burner housing beyond the position where the jet pump discharge is connected to the burner housing, the mixing tube having an open end opposite the outlet of the burner housing; a fuel gas inlet extending into the mixing tube to allow fuel gas to mix with the combustion air and flue gas in the mixing tube to form a mixture of combustion air, flue gas, and fuel gas; and a burner block connected to an outlet of the mixing tube. An embodiment of the invention is one, any or all of prior embodiments in this paragraph up through the second embodiment in this paragraph wherein the combustion air tube and the suction chamber are arranged at an angle to the burner housing. An embodiment of the invention is one, any or all of prior embodiments in this paragraph up through the second embodiment in this paragraph further comprising a flame stabilizer at the outlet of the mixing tube. An embodiment of the invention is one, any or all of prior embodiments in this paragraph up through the second embodiment in this paragraph further comprising a secondary fuel gas inlet to a manifold having at least one riser extending through an opening in the burner block to a secondary fuel gas tip providing fuel gas to a secondary flame zone. An embodiment of the invention is one, any or all of prior embodiments in this paragraph up through the second embodiment in this paragraph wherein the outlet the combustion air nozzle has a diameter d and jet pump discharge has a diameter D, and wherein a ratio of the diameter d to the diameter D is between 0.2 and 0.9. An embodiment of the invention is one, any or all of prior embodiments in this paragraph up through the second embodiment in this paragraph wherein a distance from the combustion air nozzle outlet to an inlet of the burner housing is 0.8 d to 2.0 d. An embodiment of the invention is one, any or all of prior embodiments in this paragraph up through the second embodiment in this paragraph wherein the jet pump nozzle is tapered, and the jet pump nozzle discharge has a smaller diameter than a diameter of the suction chamber.

A third embodiment of the invention is a pre-mix burner assembly comprising a jet pump comprising the combustion air tube, a flue gas inlet, and a suction chamber; the combustion air tube receiving combustion air and having an inlet at one end and a combustion air nozzle at the opposite end, the combustion air nozzle tapering to an outlet having a smaller diameter than a diameter of the combustion air tube, the combustion air tube connected to a combustion air fan; the flue gas inlet connected to the suction chamber and a source of flue gas; the suction chamber surrounding the combustion air tube with the combustion air nozzle, the suction chamber having a jet pump nozzle with a jet pump discharge, wherein the combustion air exiting the combustion air nozzle creates a negative pressure in the suction chamber and draws flue gas from the flue gas inlet into the suction chamber, the suction chamber receiving the flue gas; a burner housing positioned downstream of the jet pump discharge to receive the combustion air and flue gas from the jet pump, wherein the jet pump discharge is connected to the burner housing at a position near the middle of the burner housing; a mixing tube positioned in the burner housing and extending away from an outlet of the burner housing beyond the position where the jet pump discharge is connected to the burner housing, the mixing tube having an open end opposite the outlet of the burner housing; a fuel gas inlet extending into the mixing tube to allow fuel gas to mix with the combustion air and flue gas mixture in the mixing tube to form a mixture of combustion air, flue gas, and fuel gas; and a burner block connected to an outlet of the mixing tube; and wherein the combustion air nozzle outlet has a diameter d and the jet pump discharge has a diameter D, and wherein a ratio of the diameter d to the diameter D is between 0.2 and 0.9; or wherein a distance from the combustion air nozzle outlet to an inlet of the burner housing is 0.8 d to 2.0 d; or both. An embodiment of the invention is one, any or all of prior embodiments in this paragraph up through the third embodiment in this paragraph wherein the combustion air tube and the suction chamber are arranged at an angle to the burner housing. An embodiment of the invention is one, any or all of prior embodiments in this paragraph up through the third embodiment in this paragraph further comprising a flame stabilizer at the outlet of the mixing tube. An embodiment of the invention is one, any or all of prior embodiments in this paragraph up through the third embodiment in this paragraph further comprising a secondary fuel gas inlet to a manifold having at least one riser extending through an opening in the burner block to a secondary fuel gas tip providing fuel gas to a secondary flame zone. An embodiment of the invention is one, any or all of prior embodiments in this paragraph up through the third embodiment in this paragraph wherein the jet pump nozzle is tapered, and the jet pump nozzle discharge has a smaller diameter than a diameter of the suction chamber.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

What is claimed is:

1. A pre-mix burner assembly comprising:

a jet pump comprising a combustion air tube, a flue gas inlet, and a suction chamber;

the combustion air tube receiving combustion air and having an inlet at one end and a combustion air nozzle at the opposite end, the combustion air nozzle tapering to an outlet having a smaller diameter than a diameter of the combustion air tube, the combustion air tube connected to a combustion air fan;

the flue gas inlet connected to the suction chamber and a source of flue gas;

the suction chamber surrounding the combustion air tube and the combustion air nozzle, the suction chamber having a jet pump nozzle with a jet pump discharge, wherein the combustion air exiting the combustion air nozzle creates a negative pressure in the suction chamber and draws flue gas from the flue gas inlet into the suction chamber, the suction chamber receiving the flue gas;

a burner housing positioned downstream of the jet pump discharge to receive the combustion air and flue gas from the jet pump;

a mixing tube positioned in the burner housing and extending away from the outlet of the burner housing;

a fuel gas inlet extending into the mixing tube to allow fuel gas to mix with the combustion air and flue gas in the mixing tube to form a mixture of combustion air, flue gas, and fuel gas; and a burner block connected to an outlet of the mixing tube.

2. The burner assembly of claim 1 wherein the combustion air tube and the suction chamber are arranged at an angle to the burner housing.

3. The burner assembly of claim 1 wherein the jet pump discharge is connected to the burner housing at a position near the middle of the burner housing, and the mixing tube extends away from the outlet of the burner housing beyond the position where the jet pump discharge is connected to the burner housing, the mixing tube having an open end opposite the outlet of the burner housing.

4. The burner assembly of claim 1 further comprising a flame stabilizer at the outlet of the mixing tube.

5. The burner assembly of claim 1 further comprising a secondary fuel gas inlet connected to a manifold having at least one riser extending through an opening in the burner block to a secondary fuel gas tip providing fuel gas to a secondary flame zone.

6. The burner assembly of claim 1 wherein the combustion air nozzle outlet has a diameter d and the jet pump discharge has a diameter D, and wherein a ratio of the diameter d to the diameter D is between 0.2 and 0.9.

7. The burner assembly of claim 1 wherein a distance from the combustion air nozzle outlet to an inlet of the burner housing is 0.8 d to 2.0 d.

8. The burner assembly of claim 1 wherein the jet pump nozzle is tapered, and the jet pump nozzle discharge has a smaller diameter than a diameter of the suction chamber.

9. A pre-mix burner assembly comprising:

a jet pump comprising the combustion air tube, a flue gas inlet, and a suction chamber;

the combustion air tube receiving combustion air and having an inlet at one end and a combustion air nozzle at the opposite end, the combustion air nozzle tapering to an outlet having a smaller diameter than a diameter of the combustion air tube, the combustion air tube connected to a combustion air fan;

the flue gas inlet connected to the suction chamber and a source of flue gas;

the suction chamber surrounding the combustion air tube with the combustion air nozzle, the suction chamber having a jet pump nozzle with a jet pump discharge, wherein the combustion air exiting the combustion air nozzle creates a negative pressure in the suction chamber and draws flue gas from the flue gas inlet into the suction chamber, the suction chamber receiving the flue gas;

a burner housing positioned downstream of the jet pump discharge to receive the combustion air and flue gas from the jet pump, wherein the jet pump discharge is connected to the burner housing at a position near the middle of the burner housing;

a mixing tube positioned in the burner housing and extending away from an outlet of the burner housing beyond the position where the jet pump discharge is connected to the burner housing, the mixing tube having an open end opposite the outlet of the burner housing;

a fuel gas inlet extending into the mixing tube to allow fuel gas to mix with the combustion air and flue gas in the mixing tube to form a mixture of combustion air, flue gas, and fuel gas; and a burner block connected to an outlet of the mixing tube.

10. The burner assembly of claim 9 wherein the combustion air tube and the suction chamber are arranged at an angle to the burner housing.

11. The burner assembly of claim 9 further comprising a flame stabilizer at the outlet of the mixing tube.

12. The burner assembly of claim 9 further comprising a secondary fuel gas inlet to a manifold having at least one riser extending through an opening in the burner block to a secondary fuel gas tip providing fuel gas to a secondary flame zone.

13. The burner assembly of claim 9 wherein the outlet the combustion air nozzle has a diameter d and jet pump discharge has a diameter D, and wherein a ratio of the diameter d to the diameter D is between 0.2 and 0.9.

14. The burner assembly of claim 9 wherein a distance from the combustion air nozzle outlet to an inlet of the burner housing is 0.8 d to 2.0 d.

15. The burner assembly of claim 9 wherein the jet pump nozzle is tapered, and the jet pump nozzle discharge has a smaller diameter than a diameter of the suction chamber.

16. A pre-mix burner assembly comprising:

a jet pump comprising the combustion air tube, a flue gas inlet, and a suction chamber;

the combustion air tube receiving combustion air and having an inlet at one end and a combustion air nozzle at the opposite end, the combustion air nozzle tapering to an outlet having a smaller diameter than a diameter of the combustion air tube, the combustion air tube connected to a combustion air fan;

the flue gas inlet connected to the suction chamber and a source of flue gas;

the suction chamber surrounding the combustion air tube with the combustion air nozzle, the suction chamber having a jet pump nozzle with a jet pump discharge, wherein the combustion air exiting the combustion air nozzle creates a negative pressure in the suction chamber and draws flue gas from the flue gas inlet into the suction chamber, the suction chamber receiving the flue gas;

a burner housing positioned downstream of the jet pump discharge to receive the combustion air and flue gas from the jet pump, wherein the jet pump discharge is connected to the burner housing at a position near the middle of the burner housing;

a mixing tube positioned in the burner housing and extending away from an outlet of the burner housing beyond the position where the jet pump discharge is connected to the burner housing, the mixing tube having an open end opposite the outlet of the burner housing;

a fuel gas inlet extending into the mixing tube to allow fuel gas to mix with the combustion air and flue gas mixture in the mixing tube to form a mixture of combustion air, flue gas, and fuel gas; and a burner block connected to an outlet of the mixing tube; and wherein the combustion air nozzle outlet has a diameter d and the jet pump discharge has a diameter D, and wherein a ratio of the diameter d to the diameter D is between 0.2 and 0.9; or wherein a distance from the combustion air nozzle outlet to an inlet of the burner housing is 0.8 d to 2.0 d; or both.

17. The burner assembly of claim 16 wherein the combustion air tube and the suction chamber are arranged at an angle to the burner housing.

18. The burner assembly of claim 16 further comprising a flame stabilizer at the outlet of the mixing tube.

19. The burner assembly of claim 16 further comprising a secondary fuel gas inlet to a manifold having at least one riser extending through an opening in the burner block to a secondary fuel gas tip providing fuel gas to a secondary flame zone.

20. The burner assembly of claim 16 wherein the jet pump nozzle is tapered, and the jet pump nozzle discharge has a smaller diameter than a diameter of the suction chamber.

* * * * *